US008597213B2

(12) United States Patent
Han

(10) Patent No.: US 8,597,213 B2
(45) Date of Patent: Dec. 3, 2013

(54) CERVICAL MASSAGING DEVICE

(76) Inventor: Jungmin Han, Gyeonggi-do (KR)

( * ) Notice: Subject to any disclaimer, the term of this patent is extended or adjusted under 35 U.S.C. 154(b) by 756 days.

(21) Appl. No.: 12/918,861

(22) PCT Filed: Feb. 25, 2009

(86) PCT No.: PCT/KR2009/000898

§ 371 (c)(1),
(2), (4) Date: Aug. 23, 2010

(87) PCT Pub. No.: WO2009/107977

PCT Pub. Date: Sep. 3, 2009

(65) Prior Publication Data

US 2011/0004131 A1 Jan. 6, 2011

(30) Foreign Application Priority Data

Feb. 25, 2008 (KR) ..... 10-2008-0016742

(51) Int. Cl.
*A61H 15/00* (2006.01)
*A61H 15/02* (2006.01)

(52) U.S. Cl.
USPC ..... 601/112; 601/84; 601/133; 601/134

(58) Field of Classification Search
USPC ..... 601/49, 84–87, 89–95, 97–98, 102, 601/112, 115, 133–134, 100; 74/22 A, 25
See application file for complete search history.

(56) References Cited

U.S. PATENT DOCUMENTS 5,233,973 A * 8/1993 Gill et al. ..... 601/103
5,695,451 A * 12/1997 Kawakami ..... 601/84
6,511,448 B1 * 1/2003 Furuie et al. ..... 601/98
6,599,261 B1 * 7/2003 Chen ..... 601/115
7,108,669 B2 * 9/2006 Huang ..... 601/94
7,108,670 B2 * 9/2006 Huang ..... 601/94
2006/0287620 A1 * 12/2006 Tseng ..... 601/94
2007/0255188 A1 * 11/2007 Tseng ..... 601/94

FOREIGN PATENT DOCUMENTS

CN 2765601 Y 3/2006
JP 6-245968 A 9/1994
JP 07-124218 A 5/1995
JP 09-066083 A 3/1997
JP 11-137622 A 5/1999
JP 3-046804 B2 5/2000

(Continued)

OTHER PUBLICATIONS

International Search Report: PCT/KR2009/000898, Dated Oct. 9, 2009.

(Continued)

*Primary Examiner* — Justine Yu
*Assistant Examiner* — Christopher Miller
(74) *Attorney, Agent, or Firm* — Ladas & Parry LLP

(57) ABSTRACT

Provided is a cervical massaging device that includes: a body that is shaped to contact the side and the rear portion around a cervical spine in a neck; both side pressing members that are disposed and symmetrically spaced apart from each other in the body to contact both sides of the neck and press both sides of the neck by a driving unit; and rotary pressing members that are disposed at a predetermined distance between the side pressing members and rotated by a rotating unit to press the rear portion around the cervical spine in the neck.

22 Claims, 14 Drawing Sheets

(56) References Cited

FOREIGN PATENT DOCUMENTS

| | | | |
|---|---|---|---|
| JP | 2606541 | U | 9/2000 |
| JP | 2005-270488 | A | 10/2005 |
| JP | 3122470 | U | 5/2006 |
| JP | 2006-334060 | A | 12/2006 |
| JP | 2007-151796 | A | 6/2007 |
| KR | 20010079235 | A | 8/2001 |
| KR | 20-0292050 | Y1 | 10/2002 |
| KR | 20070100623 | A | 10/2007 |

OTHER PUBLICATIONS

Office Action of Chinese Patent Office dated Nov. 23, 2011 in Appln. No. 200980114440.7.

European Search Report; dated Mar. 30, 2012; Appln. No. 09715106.2-2318 / 2250978 PCT/KR2009000898.

* cited by examiner

CERVICAL MASSAGING DEVICE

TECHNICAL FIELD

The present invention relates to a cervical massaging device, and more particularly, to a cervical massaging device having an improved structure to be able to adjust the gap in accordance with the body size of a user, simultaneously massage both sides and rear portion around the user's cervical spine, and have a heating function and a far-infrared radiation function.

BACKGROUND ART

In general, a cervical spine of a human body implies the upper portion of the spine, vertebrae in the cervical region, which is composed of seven vertebrae, and can turn and extend, unlike the lumbar vertebrae and the thoracic vertebrae.

There are cervical disorders, such as whiplash injury, ruptured cervical disk, fracture of cervical spine, cervical spinal canal stenosis, ossification of posterior longitudinal ligament of cervical spine, and spine cord tumor, in which the whiplash injury and ruptured cervical disk are common disorders.

The whiplash injury is accompanied with swelling and aching due to tearing of the neck muscle, the muscle covering the cervical spine, and the ligament, when the muscles and ligament supporting the cervical spine are abnormally tensed or relaxed, the cervical region is excessively extended, buckled, twisted, or longitudinally pressed by external force.

Further, the ruptured cervical disk is a disorder due to disk degeneration and also called cervical disk.

The ruptured cervical disk may occurs due to an external injury or chronic stimulus, or may be degenerated by aging, or may suddenly occurs when bad positions are continuous over a long period of time in everyday life.

It is preferable to cure stiffness or relaxation of the neck muscle, which corresponds to the above case, with physiotherapy apparatuses that apply physical stimulus.

However, the existing physiotherapy apparatuses use a method of simply stimulating and heating the spine with a pressing member that reciprocates along the spine, or low-frequency physiotherapy apparatuses that intermittently apply physical stimulus to a specific portion of the human body, using low frequency, are commonly used.

The former has only a function of simply stimulating the spine, such that it is not suitable for patients with cervical spine disorders, and the latter has difficulty in directly stimulating the cervical spine.

Further, the cervical spine of the human body has a feature of smoothly bending, such that a physiotherapy apparatus considering the feature has been required.

Further, cervical massaging device that press the cervical spine in the neck in the related art massage or tap both sides of the neck by using a type of elliptical circulation or apply stimulus while moving along the cervical spine in the neck; therefore, it is difficult to efficiently relax the stiff muscles around the cervical spine only by simply stimulating specific portions around the neck.

Further, the cervical massaging device of the related art stimulate the portion around the neck without considering the body shape of the users, such that some users may become injured.

DISCLOSURE

Technical Problem

The present invention has been made in consideration of the problems and it is an object of the present invention to provide a cervical massaging device that can simultaneously press the sides and the rear portion of a neck and has a structure improved for a user to adjust the width of the portion corresponding to the user's neck in accordance with the body size of the user.

It is another object of the present invention to provide a cervical massaging device that has functions of massaging and heating, by having a heating member that radiates far-infrared rays.

Technical Solution

An exemplary embodiment of the present invention provides a cervical massaging device that includes: a body that is shaped to contact the side and the rear portion around a cervical spine in a neck; both side pressing members that are disposed and symmetrically spaced apart from each other in the body to contact both sides of the neck and press both sides of the neck by a driving unit; and rotary pressing members that are disposed at a predetermined distance between the side pressing members and rotated by a rotating unit to press the rear portion around the cervical spine in the neck, in which the driving unit includes: both side support blocks where the side pressing members are disposed, respectively; and a cam driving unit that periodically moves the side support blocks to the left and right.

The cam driving unit includes: extension bars disposed under the side support blocks, cam members where ends of the extension bars are received and have cam paths on the outer circumference to move the extension bars to the left and right in rotating; and a shaft that is fitted in the axial direction in the cam members and rotates the cam members by using driving force from a second motor.

The cam driving unit further includes guide bars that are axially connected with the side support blocks to guide the side guide blocks transversely moving.

The shaft member has a prism shape with a plurality of outer surfaces.

The rotary pressing member includes: a guide block formed in a C-shape at the top to correspond to the neck; and rotary rollers connected by a connecting shaft passing through the guide block, spaced apart at both sides of the guide block, rotatable to press the sides of the rear portion around the cervical spine in the neck, and having protrusions which is the shape of concave and convex on the outer surfaces.

The rotating unit includes: a third motor that is disposed in the body and operated by external power source; a coupler that has one end connected to the motor shaft of the third motor to be rotatable; a link that has one end connected to the other end of the coupler and is crank-rotated when the coupler rotates; a first lever member that is connected with the link to make an arc motion; and a second lever member that is connected with the other end of the first lever member by a pin and has one end connected with the connecting shaft to roll the connecting shaft in a sliding hole formed in the guide block.

The cervical massaging device further includes: a sensor sensing the number of revolution of the coupler and outputting the number of revolution into an electric signal; and a controller outputting a control signal for returning the connecting shaft to the normal position in response to a signal from the sensor, when the third motor stops.

The cervical massaging device further includes a heating member that is disposed on the guide block and generates heat by external power source.

The heating member is an innofoil that radiates far-infrared rays when external power source is supplied from the outside.

Further, the side pressing members further include a gap adjusting unit to adjust the distance therebetween.

The gap adjusting unit includes: both side cases receiving the side pressing members; both side moving nuts separably fitted to the lower portions of the side cases by connecting member; and a first motor having a first motor shaft that is fitted in the moving nuts to horizontally move the moving nuts in response to an external signal and has opposite threads at both sides on the outer surface to be screwed in the moving nuts.

The connecting member comprises; fitting grooves formed at both sides of the outer surface of the moving nut; and a plurality of fixing members extending to both sides from the lower portions of the side cases and fitted in the fitting grooves.

Advantageous Effects

The present invention has a massage function of simultaneously pressing and stimulating the sides and the rear portion of a neck and can significantly relieve fatigue around the cervical spine by using a far-infrared ray heating function. Therefore, since it is possible to variously adjust the gap between both side pressing members in accordance with the body size of a user, excessive force is not applied to the user by reducing the horizontal movement range and safety for the user is ensured, thereby improving reliability of the product.

Further, when the present invention is used as one device, it is possible to considerably improve massage efficiency by massaging the sides and the rear portion of the user's cervical region.

Further, a far-infrared ray radiation function and a heating function are provided in massaging by the innofoil, such that it is possible to easily relieve fatigue of the user.

DESCRIPTION OF DRAWINGS

FIGS. 22 and 23 are views showing a third embodiment of the present invention, in which FIG. 22 is a view schematically showing the configuration of another example of the rotating unit of the present invention and FIG. 23 is a plan view schematically showing forward/backward movement of the moving bar of the present invention.

BEST MODE

Figure 1:
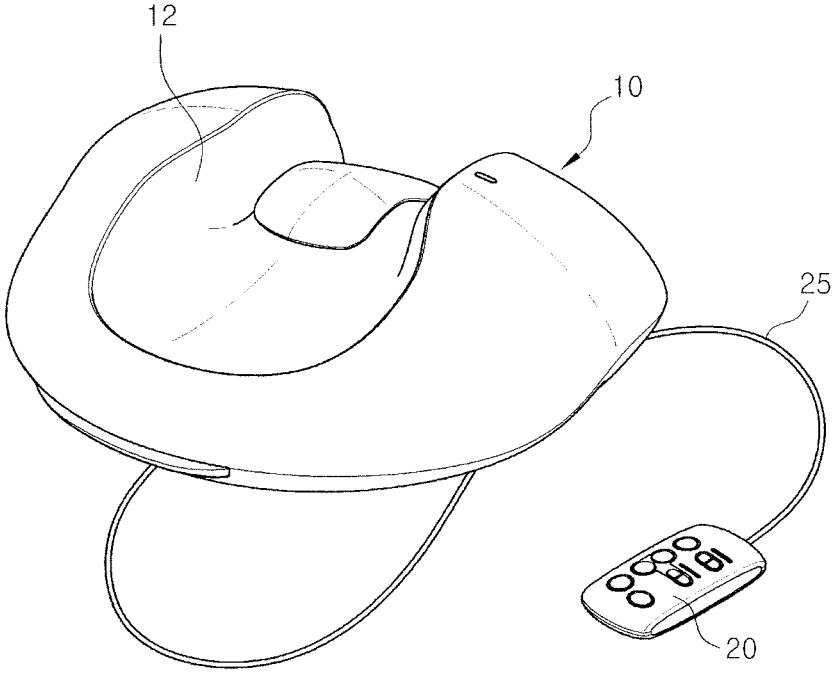
FIG. 1 is a perspective view showing the external appearance of a cervical massaging device according to the present invention.
Figure 2:
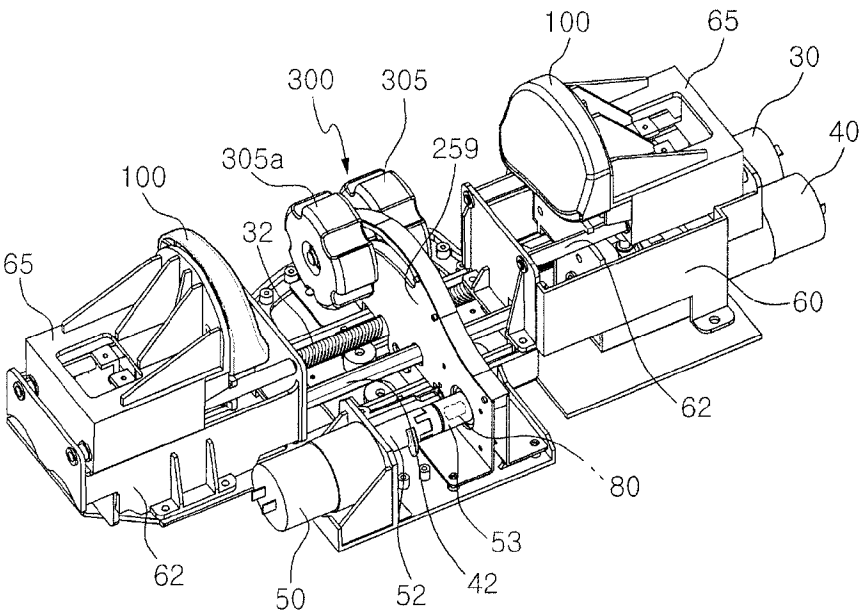
FIG. 2 is a perspective view showing the internal configuration of a cervical massaging device according to the first embodiment of the present invention.
Figure 3:
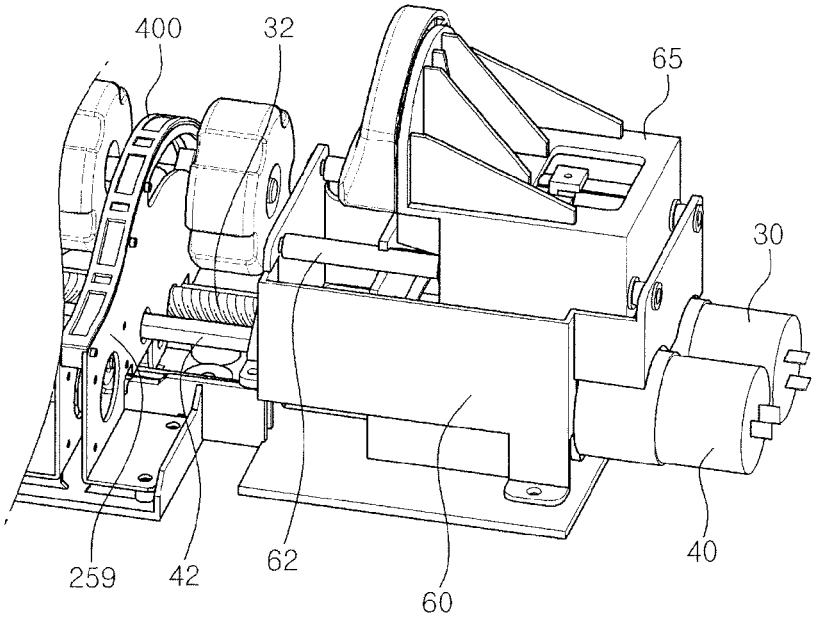
FIG. 3 is a perspective view showing a rotating unit and a driving unit of the present invention.
Figure 4:
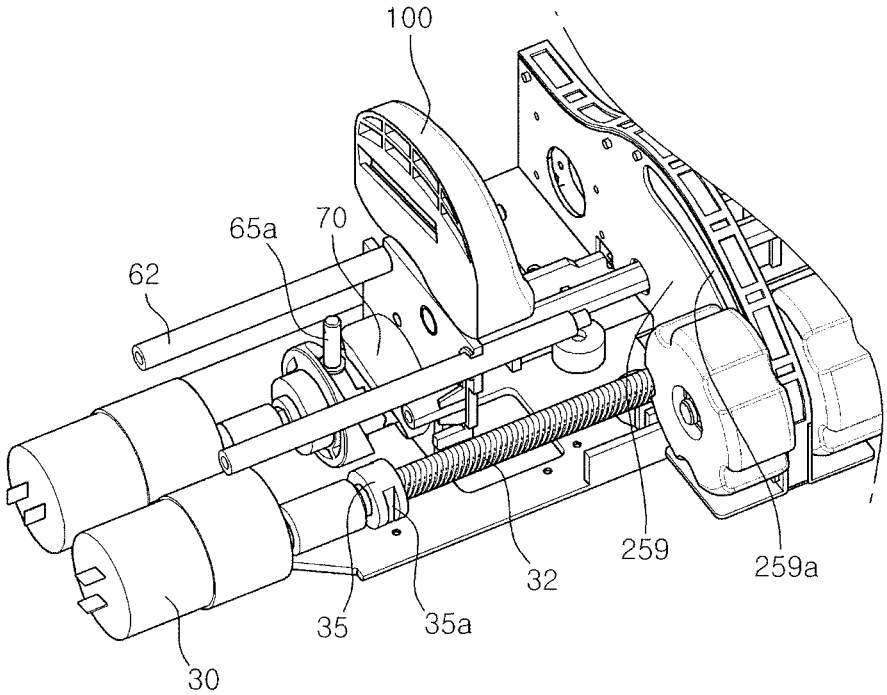
FIG. 4 is a perspective view when both cases and both side support blocks are assembled with the rotating unit and the driving unit shown in FIG. 3.
Figure 5:
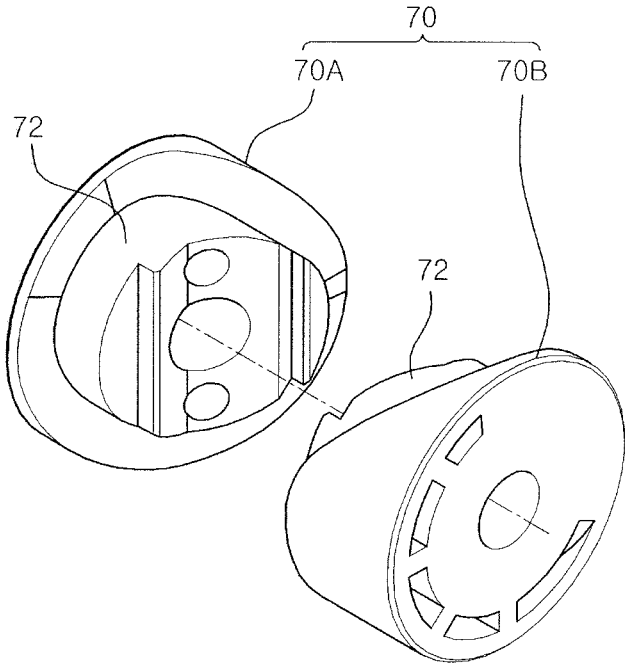
FIG. 5 is an exploded perspective view showing a cam member of the present invention.
Figure 6:
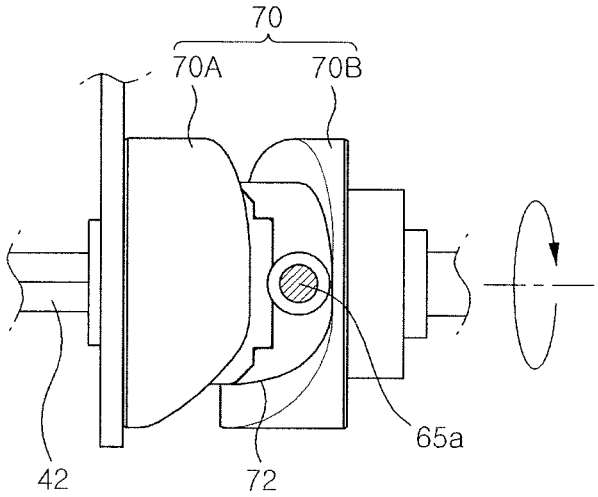
FIG. 6 is a plan view showing the relationship between an extension bar and a cam path before both side support blocks of the present invention move.
Figure 7:
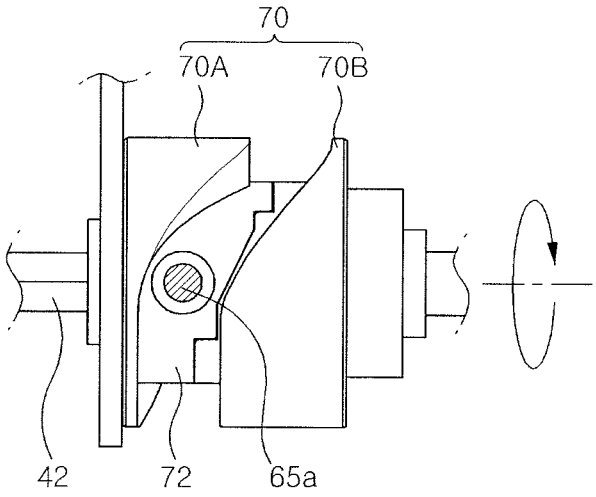
FIG. 7 is a plan view showing when the extension bar has moved along the cam path after the side support blocks of the present invention has horizontally moved.
Figure 8:
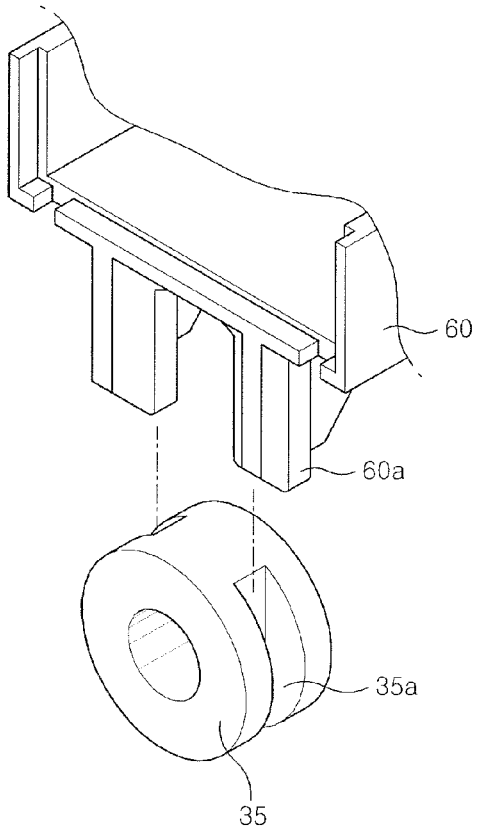
FIG. 8 is an exploded perspective view showing the structure before a moving nut is assembled with both side cases.
Figure 9:
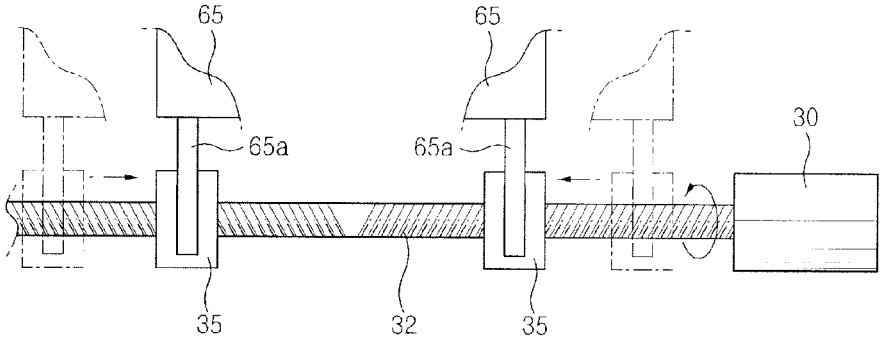
FIG. 9 is a view schematically showing use of a gap adjusting unit of the present invention, in which the side cases are moving to the center.
Figure 10:
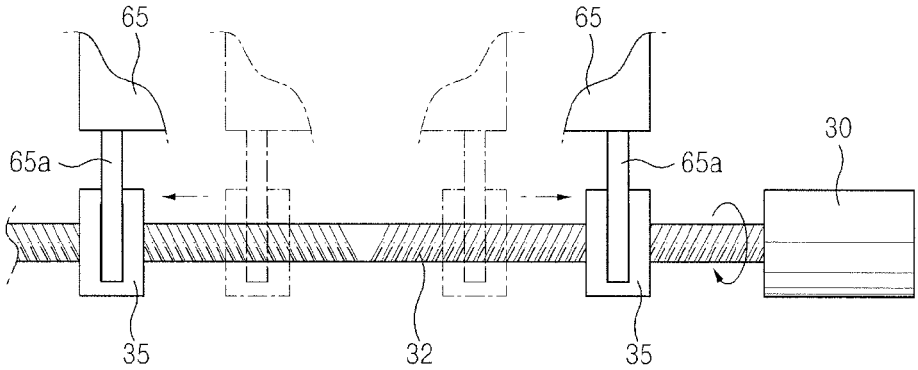
FIG. 10 is a view schematically showing use of the gap adjusting unit of the present invention, in which the side cases are returning to the outer sides.
Figure 11:
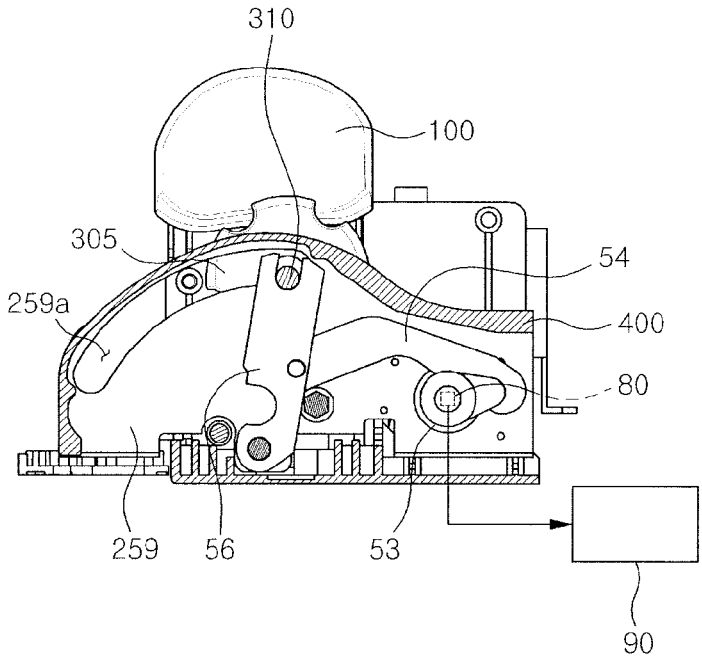
FIGS. 11, 12, and 13 are views sequentially showing the operation of the rotating unit of the present invention.
Figure 12:
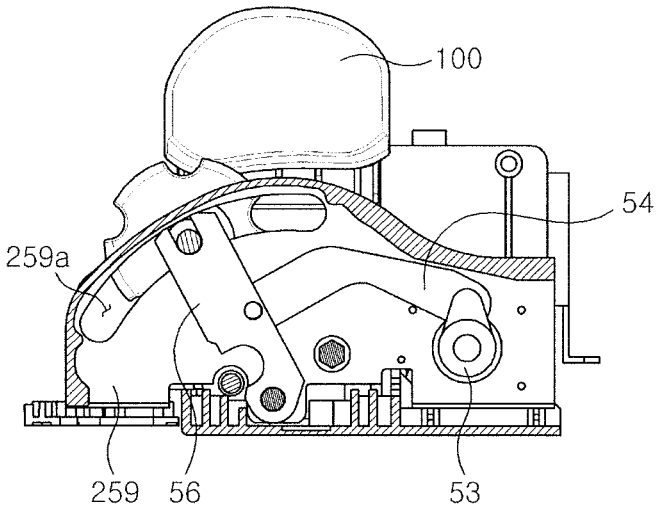
Figure 13:
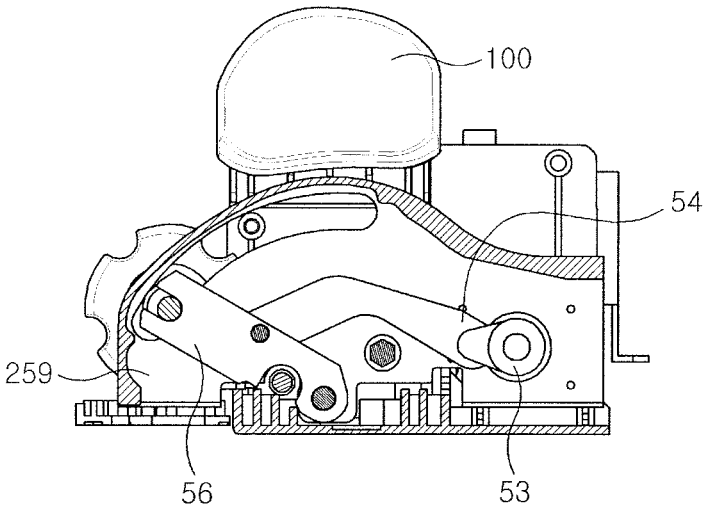
Figure 14:
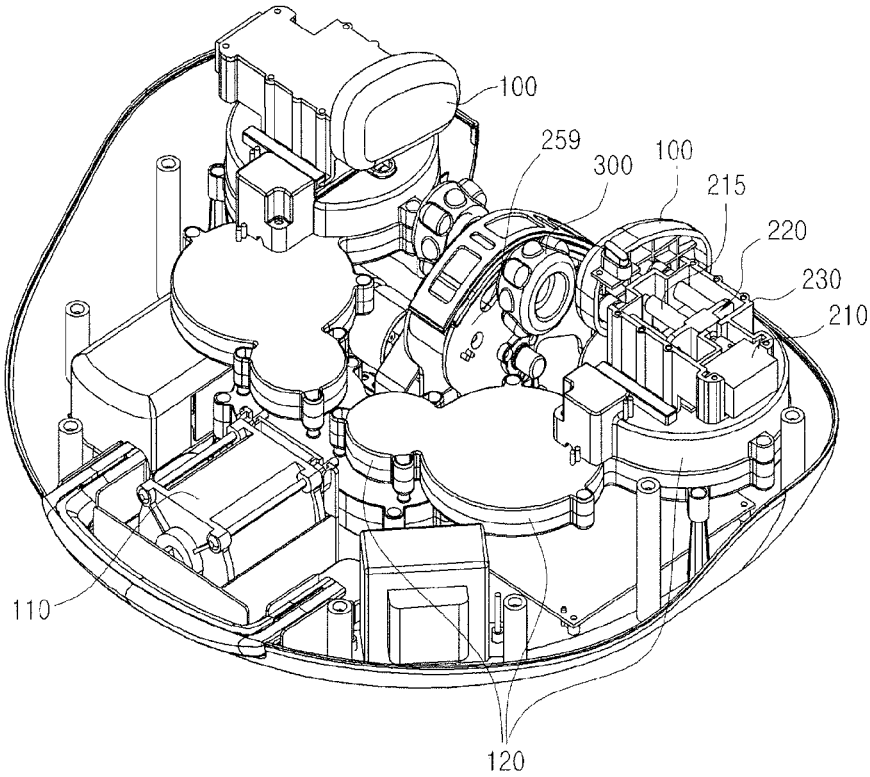
FIG. 14 is a perspective view showing the internal configuration according to the second embodiment of the present invention.
Figure 15:
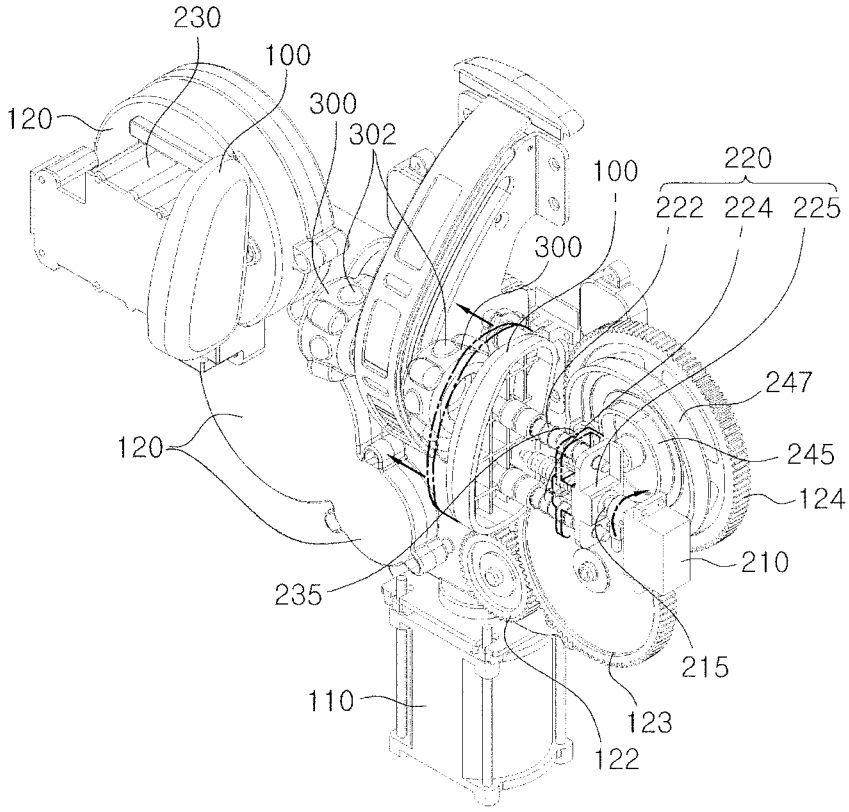
FIG. 15 is a perspective view showing the operation structure of a gap adjusting unit according to the second embodiment of the present invention.
Figure 16:
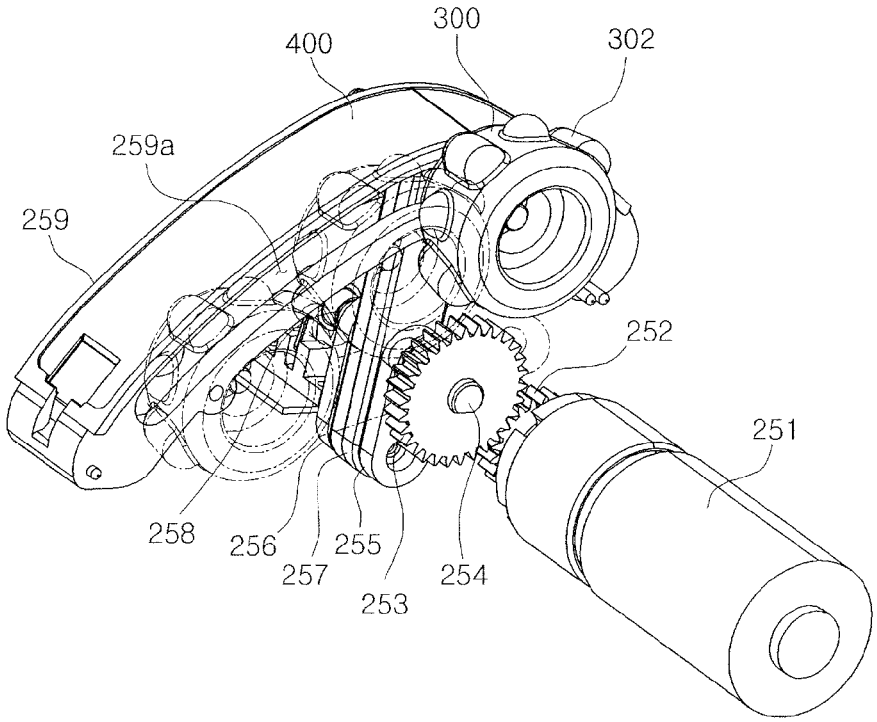
FIG. 16 is a perspective view showing a rotating unit according to the second embodiment of the present invention.
Figure 17:
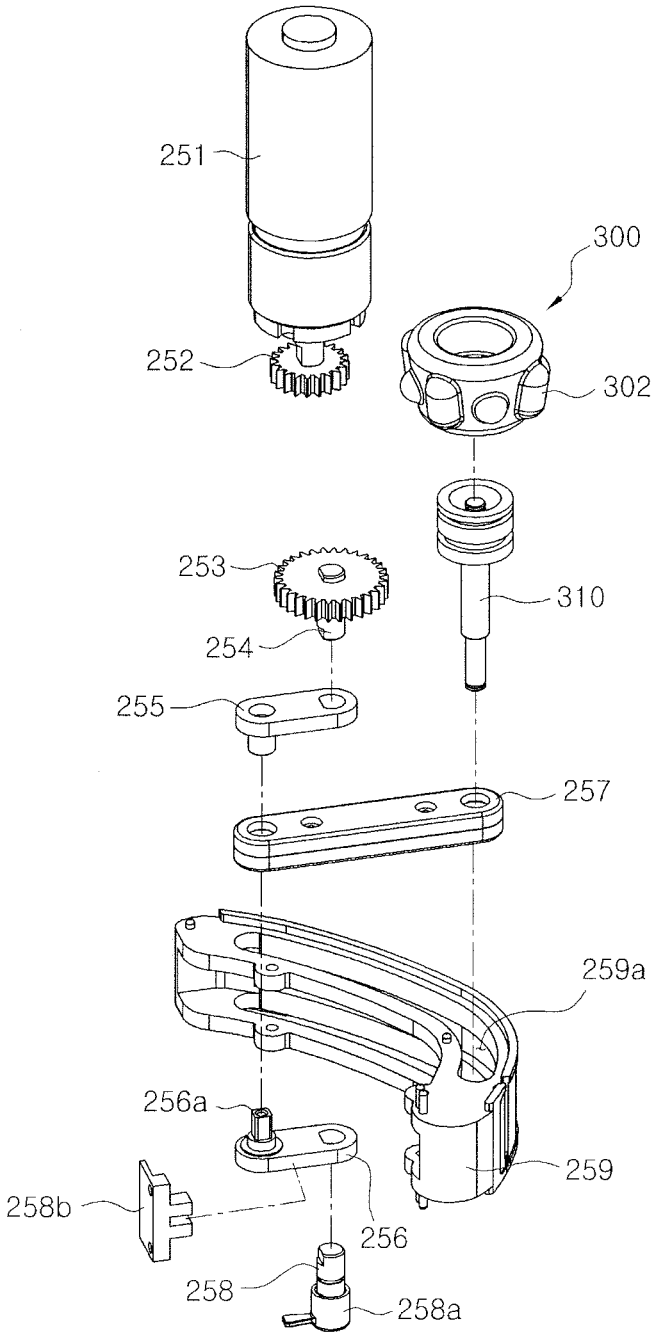
FIG. 17 is an exploded perspective view showing the rotating unit according to the second embodiment of the present invention.
Figure 18:
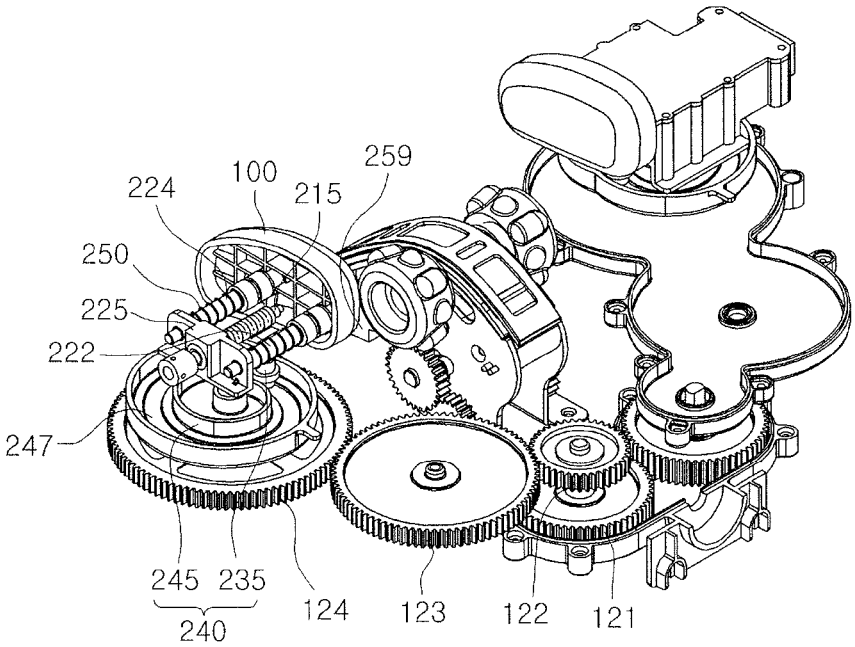
FIG. 18 is a perspective view schematically showing another example of the driving unit according to the second embodiment of the present invention.
Figure 19:
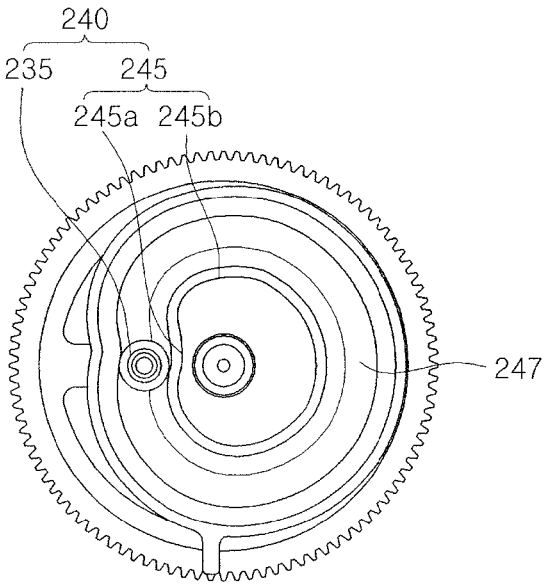
FIG. 19 is a front view when a moving pin according to the second embodiment of the present invention is positioned at a depression of an eccentric cam.
Figure 20:
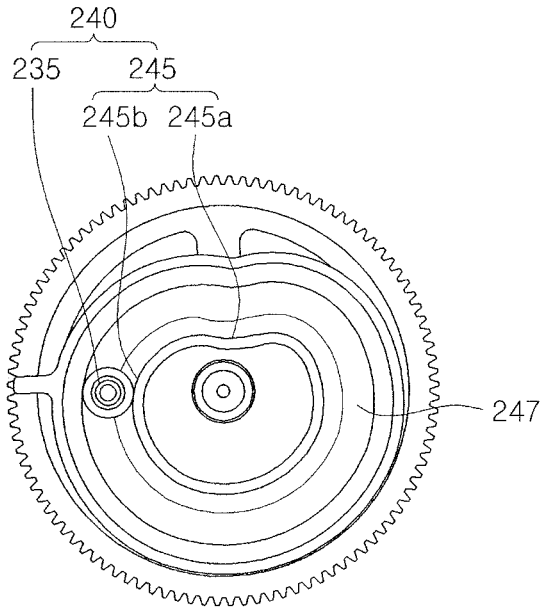
FIG. 20 is a front view when a moving pin according to the second embodiment of the present invention is positioned at a projection of the eccentric cam.
Figure 21:
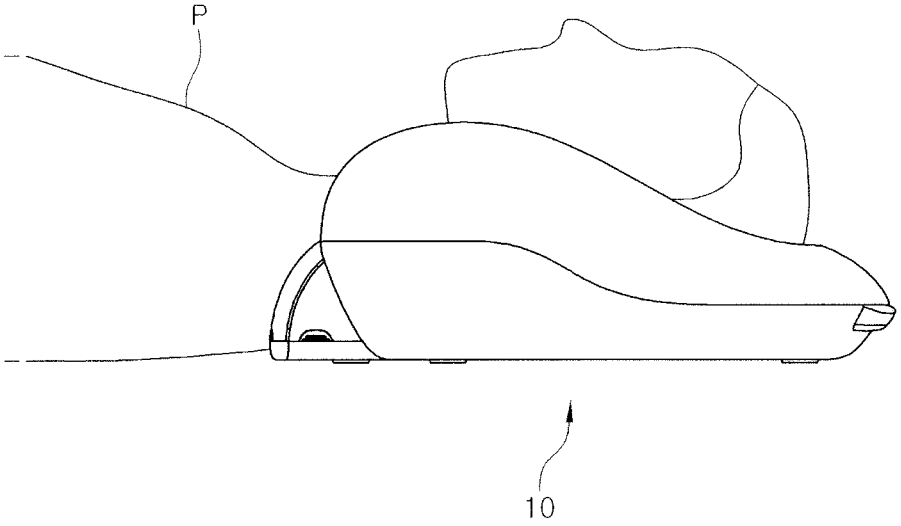
FIG. 21 is a view showing use of the present invention.

Hereinafter, exemplary embodiments of the present invention will be described in detail with reference to the accompanying drawings.

First Embodiment

Referring to FIGS. 1 to 13, a cervical massaging device according to a first embodiment of the present invention includes: a body 10 that has a shape with a space therein, corresponding to the sides and the rear portion around a cervical spine in the neck of a user; both side pressing members 100 that are disposed in the space of the body 10, have a shape corresponding to both sides around the cervical spine in the neck, and are formed in a bar shape that can be horizontally moved to the left and right by a driving unit; a rotary pressing members 300 that are disposed between the side pressing members 100 and formed in a roller shape to be rotatable by a rotating unit in order to press and stimulate the rear portion around the cervical spine in the neck; and a heating member 400 that is disposed between the rotary pressing members 300 and generates heat by external power source to radiate far-infrared rays.

In more detail, the body 10 has a cervical spine portion where the user's neck is seated and that has a recessed groove shape at the center portion 12 to simultaneously support the sides and the rear portion.

Further, in the body 10, the center portion 12 where the cervical region of the user contacts is made of a flexible material (e.g. fabric and urethane) such that the side pressing members 100 can move therein.

Further, the side pressing members 100 are space apart from each other to press and stimulate both sides of the user's neck, opposite to each other.

A driving unit includes both side support blocks 65 where the side pressing members 100 are disposed, respectively, and a cam driving unit that periodically moves the side support blocks 65 to the left and right.

The cam driving unit includes extension bars 65*a* disposed under the side support blocks 65, cam members 70 where ends of the extension bars 65*a* are received and have cam paths 72 on the outer circumference to horizontally move the extension bars 65*a* to the left and right in rotating, and a shaft member 42 that is fitted in the axial direction in the cam members 70 and rotates the cam members 70 by using driving force from a second motor 40.

The cam member 70 has the curved cam path 72 on the outer circumference, is composed of first and second cam members 70A, 70B that are divided to the left and right such that the end of the extension bar 65*a* is easily fitted, and then assembled.

The shaft member 42 is formed in a prism shape with a plurality of outer surfaces.

The rotary pressing member 300 is composed of a guide block 259 formed in a C-shape at the top to correspond to the neck, and rotary rollers 305 connected by a connecting shaft 310 passing through the guide block 259, and spaced apart at both sides of the guide block 259.

The rotary rollers 305 can rotate to press the sides of the rear portion around the cervical spine in the neck and have protrusions 305*a* which is the shape of concave and convex on the outer surfaces.

The rotating unit includes: a third motor 50 that is disposed in the body 10 and operated by external power source; a coupler 52 that has one end connected to the motor shaft of the third motor 50 to be rotatable; a link 53 that has one end connected to the other end of the coupler 52 and is crank-rotated when the coupler 52 rotates; a first lever member 54 that is connected with the link 53 to make an arc motion; and a second lever member 56 that is connected with the other end of the first lever member 54 by a pin and has one end connected with the connecting shaft 310 to roll the connecting shaft 310 in a sliding hole formed in the guide block.

The second lever member 56 has the other end fitted in the guide block 259 to be rotatable.

Further, the present invention is provided with a returning unit that returns the rotary pressing members to the normal position, when the third motor 50 stops.

The returning unit includes the third motor 50, a sensor 80 sensing the number of revolution of the coupler 52 of the link 53 and outputting it as electric signals, and a controller 90 outputting a control signal for returning the connecting shaft 310 to the normal position in response to a signal from the sensor 80, when the third motor 50 stops.

Further, the controller 90 outputs a control signal for stopping the second motor 40 and a control signal for returning the side pressing members to the initial positions (predetermined positions) by operating the first motor 30, when the pressing function of an operator is finished.

Further, the device further includes the heating member 40 that is disposed on the outer surface of the guide block 259 in the body 10 and generates heat by external power source.

It is preferable to use an innofoil that radiates far-infrared rays when generating heat, as the heating member 400.

The side pressing members 100 further include a gap adjusting unit to adjust the distance therebetween.

The gap adjusting unit includes both side cases 60 receiving and supporting the side pressing members 100, both side moving nuts 35 separably fitted to the lower portions of the side cases 60 by connecting member, and a first motor 30 having a first motor shaft 32 that has opposite threads at both sides on the outer surface to be screwed in the moving nuts 35.

Two guide bars 62 are fitted in the side cases 60 to guide horizontal movement.

Both side support blocks 65 are seated on the side cases 60 to be movable with each other.

That is, the first motor shaft 32 has a right thread on the outer surface at one side and a left thread on the outer surface at the other side.

The first motor 30 horizontally moves the moving nuts 35 by being operated in response to an external signal.

The connecting member comprises fitting grooves 35*a* formed at both sides of the outer surface of the moving nuts 35 and a plurality of fixing members 60*a* extending to both sides from the lower portions of the side cases 60 and fitted in the fitting grooves 35*a*

Though not described above, reference numeral '20' indicates the operator equipped with a switch to control the operation of the first motor 30, the second motor 40, and the third motor 50, and reference numeral '25' indicates a wire connected to the operator 20.

The operation of the present invention having this configuration is as follows.

In the cervical massaging device according to a first embodiment of the present invention, when a user contacts the neck to the body 10 and adjusts the gap between the side pressing members 100 to fit to the size of the user's body, the rear portion of the user's neck is in contact with the top of the guide block 259 and both sides of the neck are positioned between the side pressing members 100.

In this position, the user can directly adjust the gap between the side pressing members 100, using the gap adjusting unit, to fit to the width of the user's neck.

Describing the operation process of the gap adjusting unit, as the first motor 30 is operated in one direction, the first motor shaft 32 rotates in the direction and the rotational force is transmitted to the moving nuts 35 fitted at both sides of the first motor 32.

Since the fixing members 60*a* of the side cases 60 is fitted in the fitting grooves 35*a* formed on the outer circumference of the moving nuts 35 receiving the rotational force, the moving nuts horizontally move to the user's neck while being limited in rotation by the structure.

In this operation, since opposite threads are formed on the outer circumference at both sides of the first motor shaft 32, the side pressing members 100 move to the center potion (around the user's neck), when the first motor shaft 32 rotates in one direction.

On the contrary, as the first motor 30 rotates in the opposite direction, the side pressing members 100 horizontally moves to the outside and return to the initial positions.

When the side pressing members 100 are in contact with the user's neck by the above process, the user operates the operator 20 to operate the cam driving unit of the driving unit.

In the cam driving unit, as power is supplied to the second motor 40 from the outside, the shaft member 42 rotates and the cam member 70 is correspondingly rotated by the rotation of the shaft member 42.

Next, in the side support blocks 65, as the cam member 70 rotates, the extension bars 65*a* slide along the cam paths 72 formed on the outer circumference of the cam member 70 and the side support blocks 65 horizontally move along the curved cam paths 72.

This is because the cam paths 72 are diagonally formed on the outer circumference of the cam member 70 and the extension bars 65*a* horizontally move to the left and right periodically while the extension bars 65*a* move along the cam paths 72.

Therefore, as the side support blocks 65 periodically horizontally move, the side pressing members 100 combined with the side support blocks 65 correspondingly move left and right, and forward and backward, while the side pressing members 100 periodically press both sides of the user's neck, thereby pressing and massaging both sides of the neck from the left and right sides.

Further, as the user operates the operator 20 to operate the rotating unit, the rotary pressing members contact the rear portion of the cervical spin in the neck of the user and stimulate the acupoints while moving forward/backward with respect to the guide block 259.

In this operation, the rotary pressing members 300 press and massage the rear portion of the user's neck while moving forward/backward along a fitting hole 259*a* of the guide block 259.

According to the operational process of the rotating unit, the third motor 50 is operated by external power source and rotates the coupler 52 connected with the motor shaft.

As the coupler 52 rotates, the end of the link 53 which is connected with the coupler 52 crank-rotates, and the first lever member 54 connected with the end of the link 53 which is crank-rotated makes an arc shape motion.

As the first lever member 54 rotates, the second lever member 56 correspondingly rotates about the shaft fitted in the guide blocks 259.

As the second lever member 56 rotates, the connecting shaft 310 connected to one end correspondingly rotates, making an arc shape motion along the sliding hole 259*a* of the guide block 259.

Further, in the rotary pressing members, the rotary rollers 305 can rotate about the connecting shaft 310, while the protrusions 305*a* on the outer circumference of the rotary rollers 305 contact and press both sides of the rear portion around the cervical spin in the neck of the user.

Meanwhile, when power source is supplied to the heating member 400 on the outer surface of the guide block 259, the innofoil generates heat to provide a heating function and far-infrared radiation function, thereby easily relieving fatigue of the user.

Second Embodiment

FIGS. 14 to 21 show the second embodiment of the present invention, in which a driving unit includes a driving motor 110 that is disposed in a body 10 and rotated by external power source, a driving gear set 120 composed of a plurality of gears 121, 122, 123, 124 and transmitting driving force from the driving motor 110 to both side pressing members 100, and a direction converting unit 240 moving the side pressing members 100 horizontally to the left and right by converting the rotational direction of the gear (hereafter, referred to as a driving gear) at the end of the gears 121, 122, 123, 124 of the driving gear set 120 into the left-right movement direction of the side pressing members 100.

The direction switching unit 240 includes an eccentric cam 245 that is integrally formed at one side of the driving gear 124 of the driving gear set 120 such that the side pressing members 100 horizontally move to the left and right, and a moving pin 235 that is in contact with the outer circumference of the eccentric cam 245, integrally connected to a moving case 230 by a bearing.

The eccentric cam 245 has a depression 245*a* and a protrusion 245*b* at the outer circumference, a cam way 247 where the end of the moving pin 235 is disposed to support the rotation when the moving pin 235 of the moving case 230 rotates is formed outside the eccentric cam 245, in which the outer circumference is not concentric, but eccentric, to horizontally move the moving case 230 to the left and right in rotation.

That is, since the bearing-shaped moving pin 235 rotates along the inside of the cam way 247 of the eccentric cap 245, with the moving pin 235 always partially contacting the outer circumference of the eccentric cam 245, the moving case 230 integrally connected to the moving pin 235 horizontally moves.

Further, the rotary pressing member 300 is composed of rotatable rollers spaced apart from each other at both sides to press both sides of the rear portion around the cervical spin in the neck, and a plurality of pressing protrusions 302 are formed on the outer circumferences of the rollers.

The rotating unit includes: a rotary motor 251 that is disposed in the body 10 and has a motor shaft 252 rotated by external power source; a rotary gear 253 that is engaged with the motor shaft 252 of the rotary motor 251 to be rotated about rotary shafts 254, 258; rotating levers 255, 256 through which the rotary shafts 254, 258 of the rotary gear 253 pass such that the rotary shafts 254, 258 are integrally operated, and which are rotated by the rotation of the rotary shafts 254, 258; a rotating rod 257 that is connected to the lower portions of the rotating levers 255, 256 by a pin and rotated by the movement of the rotating levers 255, 256; a connecting shaft 310 that is connected to the upper portion of the rotating rod 257, connects the rotary pressing members 300 at both sides, and is rolled by the rotation of the rotating rod 257; and a guide block 259 that is disposed between the rotary pressing members 300 and through which the connecting shaft 310 is partially fitted to guide the connecting shaft 310 to roll.

The rotating levers 255, 256 are disposed at both sides from the rotating rod 257 at the center, a pin 256*a* integrally protrudes from the lower portion of the rotating lever 256 of the rotating levers 255, 256 and connected to the rotating lever 255 by the pin 256*a*.

Further, the pin 256*a* has a rectangular cross section defined by the outer surface, such that the rotating levers 255, 256 are simultaneously rotated by the cross-sectional structure when being inserted.

The rotary shafts 254, 258 are fitted in the rotating levers 255, 256 at the left and right sides, in which the rotating shaft 254 is fitted in the center of the rotary gear 253 and the rotary shaft 258 is disposed in a housing 258*a*, which has one end fitted in the rotating lever 256 and the other end fixed to the guide block 259, to be rotatable.

Further, the rotary shafts 254, 258 at both sides pass through the rotating levers 255, 256, respectively, and the connected portions are moved together by surface contact.

The guide block 259 is in contact with the rear portion of the user's neck to support the neck and has an arc-shaped fitting hole 259*a* that the connecting shaft 310 passes through to support the rotation of the rotating rod 257, when seen from a side.

Though not shown in the figure, the rotary pressing member 300 is connected with the end of the connecting shaft 310 by a bearing to be rotatable.

That is, as the rotary motor 251 rotates, the rotary gear 253 engaged with the motor shaft 252 correspondingly rotates, the rotary shaft 254 integrally formed with the rotary gear 253 rotates the rotating levers 255, 256, and the rotating rod 257 fitted in the rotating levers 255, 256 by the pin rotates about the rotary shafts 254, 258 at both sides, such that the connecting shaft 310 rolls inside the fitting-groove 259*a*.

Further, it is preferable that the side pressing members 100 are provided with a gap adjusting unit that adjusts the gap therebetween in accordance with the body size of the user.

The gap adjusting unit includes: a moving assembly 220 integrally connected to predetermined sides of the side pressing members 100; an adjusting motor 210 passing through a predetermined portion of the moving assembly 220 and having a motor shaft 215 with a thread on the outer circumference to horizontally move the moving assembly 220 to the left and right by rotating forward/backward when external power source is supplied from the outside; and a moving case 230 through which a portion of the moving assembly 220 passes to support the horizontal movement of the side pressing members 100.

The moving assembly 220 is composed of a plurality of support shafts 222, 224 that is spaced apart from each other and protrudes outside at one side of the side pressing members 100, and a moving block 225 in which the ends of the support shafts 222, 224 are fixed, which is engaged with the motor shaft 215 of the adjusting motor 210 and horizontally moves along the thread of the motor shaft 215 when the adjusting motor 210 operates.

Preferably, a shock-absorbing member 250 having a shock-absorbing function is interposed between the support shafts 222, 224 and the moving block 225, and the shock-absorbing member 250 may be a spring member or a material (e.g. silicon) having its own elasticity.

The moving case 230 is seated on the top of the driving gear 124 and moved horizontally by the moving pin 235, and receives the motor shaft 215 of the adjusting motor 210 and the support shafts 222, 224.

Though not described, reference numeral '20' indicates an operator with a switch for controlling the operation of the rotary motor 251 and the driving motor 110 and reference numeral '25' indicates a wire connected with the operator 20.

The operation of the second embodiment having this structure of the present invention is described as follows.

In the cervical massaging device according to the second embodiment of the present invention, when a user contacts the neck to the body 10 and adjusts the gap between the side pressing members 100 to fit to the size of the user's body, the rear portion of the user's neck is in contact with the top of the guide block 259 and both sides of the neck are positioned between the side pressing members 100.

In this process, the gap between the side pressing members 100 can be adjusted by the gap adjusting unit, and in the operational process, as the motor shaft 215 is rotated in the normal direction by operating the adjusting motor 210, the moving block 225 connected with the motor shaft 215 moves forward along the thread formed on the outer circumference of the motor shaft 215, such that gap between the side pressing members 100 decreases, whereas as the motor shaft 215 is rotated in the opposite direction, the gap between side pressing members 100 increases.

Next, as the user operates the operator 20 to operate the rotary motor 251 and the driving motor 110, the rotary pressing member 300 presses and massages the rear portion of the user's neck while moving forward/backward along the fitting hole 259*a* of the guide block 259 by the operation of the rotary motor 251, and the side pressing members 100 press and massage both sides of the neck from the left and right sides while moving left and right by the operation of the driving motor 110.

In this operation, according to the operational process of the rotary pressing member 300, the rotary gear 253 engaged with the motor shaft 252 correspondingly rotates, when the rotary motor 251 operates, the rotary shaft 254 integrally formed with the rotary gear 253 rotates the rotating lever 255 at one side and the rotating lever 256 at the other side which is connected with the rotating lever 255 by the pin 256*a*, such that the rotating rod 257 integrally connected by the pin 256*a* rotates about the rotary shafts 254, 258 at both sides, and accordingly, the connecting shaft 310 rolls in the fitting groove 259*a* and the rotary pressing member 300 moves forward/backward.

Further, in the operational process of the side pressing members 100, as the motor shaft of the driving motor 110 rotates, the gears of the driving gear assembly 120 engaged with the motor shaft are rotated, and the driving gear 124 is correspondingly rotated, because the gears of the driving gear set 120 are engaged with each other. Further, the moving pin 235 of the moving case 230 contacts the path of the cam way 247 of the driving gear 124 while the moving pin 235 moves left and right due to a difference in outer diameter between the depression 245*a* and the protrusion 245*b* of the eccentric cam 245 and moves the moving case 230 to the left and right.

Accordingly, the side pressing members 100 press and massage both sides around the cervical spin in the neck of the user while moving left and right and the rotary pressing member 300 presses and massages the rear portion around the cervical spin in the neck, such that the entire portion around the cervical spin is massaged, thereby improving efficiency of the massage by considerably relieving fatigue around the cervical spine.

Meanwhile, when power source is supplied to the heating member 400 on the outer surface of the guide block 259, the innofoil generates heat to provide heating function and far-infrared radiation function, thereby easily relieving fatigue of the user.

Third Embodiment

Figure 22:
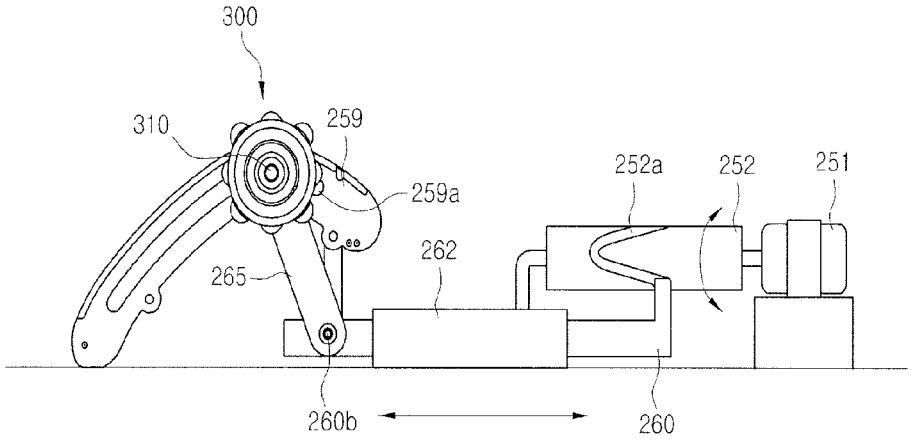
Figure 23:
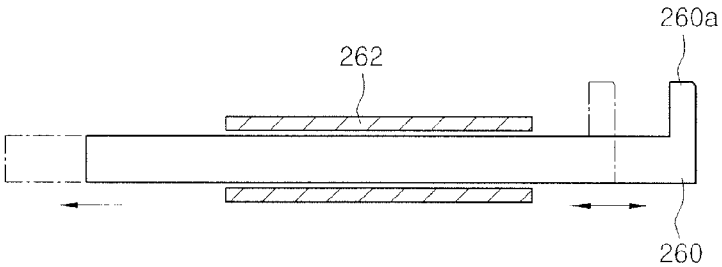

Meanwhile, FIGS. 22 and 23 show another example of a rotating unit, which includes: a rotary motor 251 that is rotated by external power source, disposed in a body 10, and has a motor shaft 252 having a slide groove 252*a* on the outer circumference; a moving bar 260 that has a moving protrusion 260*a* sliding along the slide groove 252*a* of the motor shaft at one end, and the other end connected with a link member 265, which is connected with rotary pressing members 300, to be operated by a link shaft 260*b* in order to convert the rotational force of the motor shaft 252 into a straight motion; a moving guide 262 where a portion of the moving bar 260 is disposed to prevent left/right movement and guide the moving bar 260 moving straight; a connecting shaft 310 that is connected to the upper portion of the link member 265 and connects the rotary pressing members 300 at both sides; and a guide block 259 that is disposed between the rotary pressing members 300 through which a portion of the connecting shaft 310 passes to allow the connecting shaft 310 to roll.

Therefore, a moving protrusion 260*a* of the moving bar 260 is slidably disposed in the slide groove 252*a* formed on the outer circumference of the motor shaft 252 of the rotary motor 251, such that the moving bar 260 moves forward/backward along the path of the slide groove 252*a* when the motor shaft 252 rotates, the link member 265 rotate about the link shaft 260*b* when the moving bar 260 moves forward/backward, and the connecting shaft 310 moves forward/backward while rolling in the fitting groove 259*a* of the guide block 259 by the rotation of the link member 265.

That is, the configuration in which the rotating unit converts the rotational force of the rotary motor 251 into straight motion to apply force that moves the rotary pressing members 300 forward/backward can be implemented by a different configuration from the exemplary embodiments described above.

The invention claimed is:

1. A cervical massaging device comprising:

a body that is shaped to contact the side and the rear portion around a cervical spine in a neck;

two side pressing members that are disposed and symmetrically spaced apart from each other in the body configured to contact both sides of the neck and press both sides of the neck by a driving unit; and rotary pressing members that are disposed at a predetermined distance between the side pressing members and rotated by a rotating unit to press the rear portion around the cervical spine in the neck, wherein the rotary pressing members include:

a guide block formed in a C-shape at the top to correspond to the neck and having an arced shaped fitting hole; and rotary rollers connected by a connecting shaft passing through the arced shaped fitting hole of the guide block, spaced apart at both sides of the guide block, and movable through the arced shaped fitting hole so that rotary rollers are configured to be rotatable to press the sides of the rear portion around the cervical spine in the neck.

2. The cervical massaging device according to claim 1, wherein the driving unit includes:

two side support blocks where the side pressing members are disposed, respectively; and a cam driving unit that periodically moves the side support blocks to the left and right.

3. The cervical massaging device according to claim 2, wherein the cam driving unit includes:

extension bars disposed under the side support blocks, cam members where ends of the extension bars are received and have cam paths on the outer circumference to move the extension bars to the left and right when the cam members rotate; and a shaft member that is fitted in the axial direction in the cam members and rotates the cam members by using a driving force from a second motor.

4. The cervical massaging device according to claim 3, wherein the cam driving unit further includes guide bars that are axially connected with the side support blocks to guide the side support blocks transversely moving.

5. The cervical massaging device according to claim 3, wherein the shaft member has a prism shape with a plurality of outer surfaces.

6. The cervical massaging device according to claim 1, wherein the rotary rollers also have protrusions which are the shape of concave and convex on the outer surfaces.

7. The cervical massaging device according to claim 6, wherein the rotating unit includes:

a third motor that is disposed in the body and operated by an external power source;

a coupler that has one end connected to the motor shaft of the third motor to be rotatable;

a link that has one end connected to the other end of the coupler and is crank-rotated when the coupler rotates;

a first lever member that is connected with the link to make an arc motion; and a second lever member that is connected with the other end of the first lever member by a pin and has one end connected with the connecting shaft to roll the connecting shaft in a sliding hole formed in the guide block.

8. The cervical massaging device according to claim 7, further comprising:

a sensor sensing the number of revolutions of the third motor and outputting the number of revolutions into an electric signal; and a controller outputting a control signal for returning the connecting shaft to the normal position in response to a signal from the sensor, when the third motor stops.

9. The cervical massaging device according to claim 6, further comprising a heating member that is disposed on the guide block and generates heat by an external power source.

10. The cervical massaging device according to claim 9, wherein the heating member is configured to radiate far-infrared rays when external power source is supplied from the outside.

11. The cervical massaging device according to claim 1, wherein the side pressing members further include a gap adjusting unit for adjusting the distance between the side pressing members.

12. The cervical massaging device according to claim 11, wherein the gap adjusting unit includes:

two side cases receiving the side pressing members;

two side moving nuts separably fitted to the lower portions of the side cases by a connecting member; and a first motor having a first motor shaft that is fitted in the moving nuts to horizontally move the moving nuts in response to an external signal and the first motor shaft has opposite threads at both sides on the outer surface to be screwed in the moving nuts.

13. The cervical massaging device according to claim 12, wherein the connecting member comprises:

fitting grooves formed at both sides of the outer surface of the moving nuts; and a plurality of fixing members extending to both sides of the outer surface of the moving nuts from the lower portions of the side cases and fitted in the fitting grooves.

14. The cervical massaging device according to claim 1, wherein the driving unit includes:

a driving motor that is rotated by an external power source;

a driving gear set composed of a plurality of gears and transmitting a driving force from the driving motor to both side pressing members; and a direction converting unit moving the side pressing members horizontally to the left and right by converting the driving rotational force of the gear at the end of the gears of the driving gear set into the left-right movement direction of the side pressing members.

15. The cervical massaging device according to claim 14, wherein the direction switching unit includes:

an eccentric cam that is integrally formed at one side of the gear at the end of the gears of the driving gear set such that the side pressing members horizontally move to the left and right, and the eccentric cam has a depression and a protrusion which have different outer diameter on the outer circumference; and a moving pin that is in contact with the outer circumference of the eccentric cam and integrally connected to a moving case to be rotatable.

16. The cervical massaging device according to claim 14, wherein the rotary pressing member is composed of rotatable rollers spaced apart from each other at both sides configured to press both sides of the rear portion around the cervical spine, and a plurality of pressing protrusions are formed on the outer circumferences.

17. The cervical massaging device according to claim 14, wherein the rotating unit includes:

a rotary motor that is disposed in the body and has a motor shaft rotated by the external power source;

a rotary gear that is engaged with the motor shaft of the rotary motor to be rotated about the motor shaft;

rotating levers through which the rotary shaft of the rotary gear passes to be integrally operated;

a rotating rod that is connected to the lower portions of the rotating levers by a pin and rotated by the movement of the rotating levers;

the connecting shaft is connected to the upper portion of the rotating rod and connects the rotary pressing members at both sides; and the guide block is disposed between the rotary pressing members and through which the connecting shaft is partially fitted to guide the connecting shaft to roll.

18. The cervical massaging device according to claim 14, wherein the rotating unit includes:

a rotary motor that is rotated by the external power source, disposed in the body, and has a motor shaft having a slide groove on the outer circumference;

a moving bar that has one end sliding along the slide groove of the motor shaft, and the other end linked with a link member connected with rotary pressing members, in order to convert the rotational force of the motor shaft into a straight motion;

a moving guide where a portion of the moving bar is disposed to prevent left/right movement and guide the moving bar moving straight;

the connecting shaft is connected to the upper portion of the link member and connects the rotary pressing members at both sides; and the guide block is disposed between the rotary pressing members through which a portion of the connecting shaft passes to allow the connecting shaft to roll.

19. The cervical massaging device according to claim 14, wherein the side pressing members further include a gap adjusting unit for variously adjusting the distance between the side pressing members.

20. The cervical massaging device according to claim 19, wherein the gap adjusting unit includes:

a moving assembly integrally connected to predetermined sides of the side pressing members;

an adjusting motor passing through a predetermined portion of the moving assembly and having a motor shaft with a thread on the outer circumference to horizontally move the moving assembly to the left and right by rotating forward/backward when external power source is supplied from the outside; and a moving case through which a portion of the moving assembly passes to support the horizontal movement of the side pressing members.

21. The cervical massaging device according to claim 20, wherein the moving assembly includes:

a plurality of support shafts that are spaced apart from each other and protrude outside at one side of the side pressing members; and a moving block in which the ends of the support shafts are fixed, which is engaged with the motor shaft of the adjusting motor and horizontally moves along the thread of the motor shaft when the adjusting motor operates.

22. The cervical massaging device according to claim 21, further comprising a shock-absorbing member having a shock-absorbing function and interposed between the support shafts and the moving block.

* * * * *